United States Patent [19]

Nakamura et al.

[11] 4,450,117

[45] May 22, 1984

[54] VARIABLE VENTURI-TYPE CARBURETOR

[75] Inventors: Norihiko Nakamura; Takaaki Ito; Takashi Katou, all of Mishima; Yozo Ota, Chiryu; Toshiharu Morino, Mie, all of Japan

[73] Assignees: Toyota Jidosha Kabushiki Kaisha, Toyota; Aisan Industry Co., Ltd., Obu, both of Japan

[21] Appl. No.: 417,907

[22] Filed: Sep. 14, 1982

[30] Foreign Application Priority Data

Dec. 21, 1981 [JP] Japan ..... 56-205201

[51] Int. Cl.[3] ..... F02M 9/06

[52] U.S. Cl. ..... 261/39 A; 261/44 C; 261/121 B; 261/52

[58] Field of Search ..... 261/44 C, 121 B, 39 A, 261/52

[56] References Cited

U.S. PATENT DOCUMENTS

| | | | |
|---|---|---|---|
| 3,243,167 | 3/1966 | Winkler | 261/44 C |
| 3,249,345 | 5/1966 | Gast | 261/39 D |
| 3,493,217 | 2/1970 | Farley | 261/121 B |
| 3,900,014 | 8/1975 | Bundesen et al. | 261/44 C |
| 3,956,434 | 5/1976 | Dickensheets et al. | 261/44 C |
| 4,117,046 | 9/1978 | Nohira et al. | 261/44 C |
| 4,276,238 | 6/1981 | Yoshikawa et al. | 261/44 C |
| 4,302,404 | 11/1981 | Nakamura et al. | 261/44 C |

FOREIGN PATENT DOCUMENTS

| | | | |
|---|---|---|---|
| 54-142421 | 11/1979 | Japan | 261/44 C |
| 55-46015 | 3/1980 | Japan | 261/121 B |
| 510753 | 8/1939 | United Kingdom | 261/44 C |
| 983730 | 2/1965 | United Kingdom . | |
| 1149205 | 4/1969 | United Kingdom . | |
| 1300985 | 12/1972 | United Kingdom | 261/44 C |

*Primary Examiner*—Tim R. Miles

*Attorney, Agent, or Firm*—Finnegan, Henderson, Farabow, Garett, Dunner

[57] ABSTRACT

A variable venturi-type carburetor comprising a suction piston, a fuel passage, and a needle fixed onto the suction piston and extending through the fuel passage. An air bleed passage is connected to the fuel passage. During engine starting, before the engine begins to rotate by its own power, the vacuum chamber of the suction piston is open to the atmosphere and the air bleed passage is shut off. When the engine begins to rotate by its own power, the vacuum chamber of the suction piston is closed from the atmosphere. After this, the air bleed passage is gradually opened. Such control of the closing of the vacuum chamber and the opening of the air bleed passage prevents engine stall by preventing the fuel mixture from becoming excessively lean when the engine first begins to rotate on its own power and then prevents engine misfires by subsequently reducing the air-fuel ratio to a lean mixture.

15 Claims, 7 Drawing Figures

VARIABLE VENTURI-TYPE CARBURETOR

BACKGROUND OF THE INVENTION

The present invention relates to a fuel-feeding device of a variable venturi-type carburetor.

When starting an engine from a low temperature, a rich fuel mixture of an approximately 1:1 through 2:1 air-fuel ratio is necessary during the time the engine is rotated by the starter motor and an increased 8:1 through 10:1 air-fuel ratio is necessary after the engine begins to rotate by its own power. Toward this end, conventional carburetors have been constructed with the choke valve directly controlled by the vacuum produced in the intake passage located downstream of the throttle valve, so that the choke valve is opened when the engine begins to rotate by its own power and, accordingly, vacuum in the intake passage becomes great. However, in this case wherein the choke valve is directly controlled by vacuum produced in the intake passage, the opening of the choke valve occurs instantaneously when the engine begins to rotate by its own power. This along with the delay in response of the fuel-feeding operation temporarily results in an excessively lean air-fuel mixture fed into the cylinder of the engine. This in turn results in the problem of the engine stopping as soon as it begins to rotate on its own power.

To eliminate this problem, other conventional carburetors have been constructed to increase the amount of fuel fed into the cylinder of the engine when the engine begins to rotate by its own power so as to provide the optimum air-fuel ratio at that time. In such a case, however, the air-fuel mixture fed into the cylinder of the engine becomes excessively rich after the elapse of the delay in response of the fuel-feeding operation after the engine begins to rotate by its own power, causing the problem of misfires.

SUMMARY OF THE INVENTION

An object of the present invention is to provide a fuel-feeding device for a variable venturi-type carburetor, which prevents the occurrence of engine stoppage immediately after the engine begins to rotate by its own power and which prevents the occurrence of misfires after a brief delay following the rotation of the engine under its own power.

According to the present invention, there is provided a variable venturi-type carburetor comprising: an intake passage formed in said carburetor and having an inner wall; a casing having therein an interior chamber which extends perpendicular to said intake passage; a suction piston movably inserted into said casing and having a tip face which projects into said intake passage and defines a venturi portion, said suction piston dividing the interior chamber of said casing into an atmospheric pressure chamber and a vacuum chamber which is connected to said venturi portion for moving said suction piston in response to a change in the amount of air flowing within said intake passage; a throttle valve arranged in said intake passage located downstream of said suction piston; a fuel passage having a metering jet therein and being open to said intake passage for feeding fuel into said intake passage; a needle fixed onto the tip face of said suction piston and extending through said fuel passage and said metering jet; an air bleed passage having an air inlet and an air outlet which is open to said fuel passage, said air inlet being open to the atmosphere; an air feed passage having an air inlet and an air outlet which is open to said vacuum chamber, said air inlet being open to the atmosphere; and control means arranged in said air bleed passage and said air feed passage and controlling the flow areas of said air bleed passage and said air feed passage in response to a change in vacuum produced in said intake passage located downstream of said throttle valve for opening said air feed passage and shutting off said air bleed passage when the level of said vacuum is smaller than a predetermined level and for shutting off said air feed passage and opening said air bleed passage when the level of said vacuum is greater than the predetermined level, said control means having a delay device for delaying the shutting-off operation of said air feed passage and/or the opening operation of said air bleed passage for a period of time after the level of said vacuum becomes greater than the predetermined level.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The present invention may be more fully understood from the description of preferred embodiments of the invention set forth below, together with the accompanying drawings.

DESCRIPTION OF PREFERRED EMBODIMENTS

Figure 1:
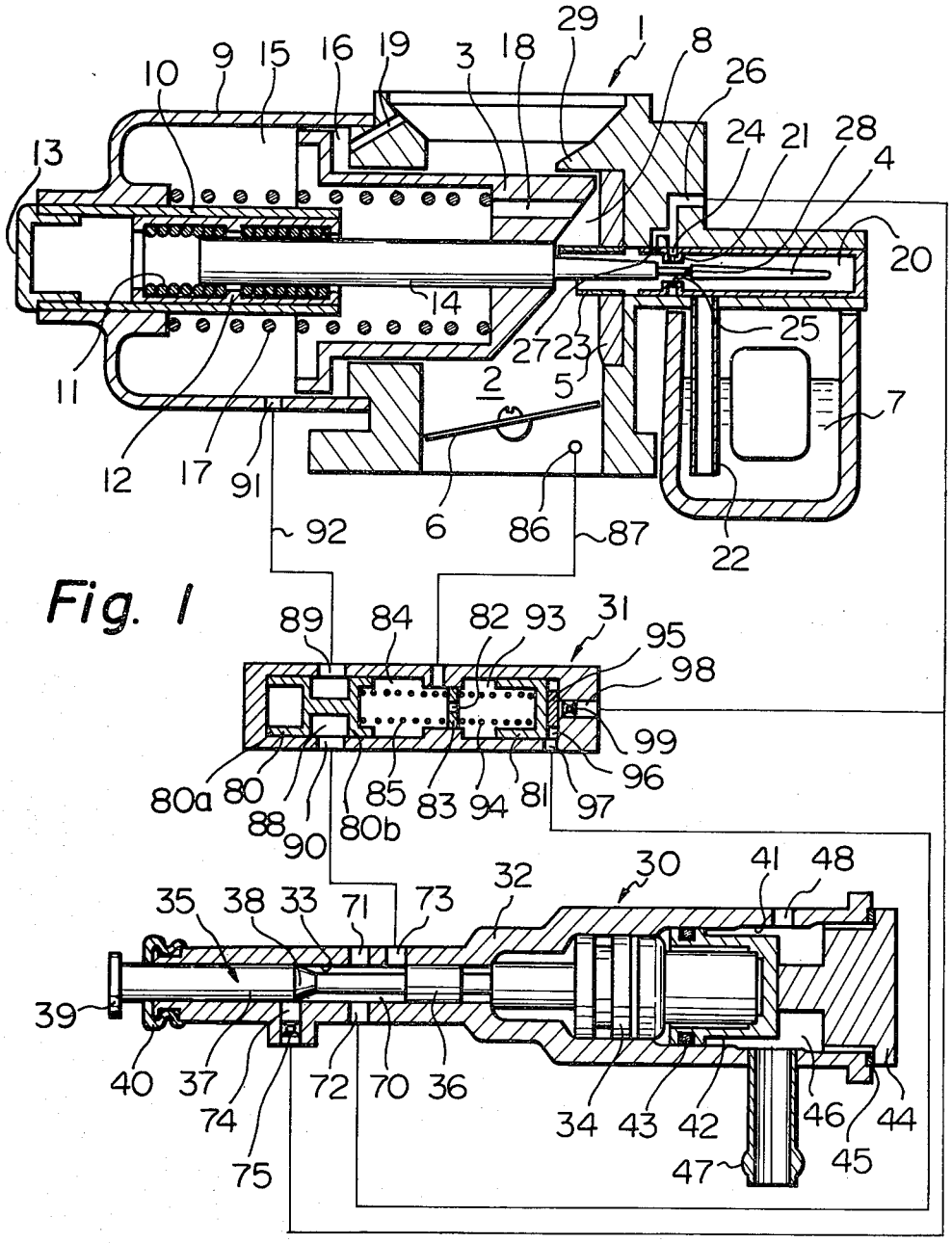
FIG. 1 is a cross-sectional side view of a carburetor and a control device according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3. Numeral 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1. A guide sleeve 10, extending within the casing 9 in the axial direction thereof is attached to the casing 9. A bearing 12, equipped with a plurality of balls 11, is inserted into the guide sleeve 10, and the outer end of the guide sleeve 10 is closed with a blind cap 13. A guide rod 14 is fixed onto the suction piston 3 and is inserted into the bearing 12 so as to be movable in its axial direction. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3. A compression spring 17 for continuously biasing the suction piston 3 toward the venturi portion 8 is inserted into the vacuum chamber 15. The vacuum chamber 15 is connected to the venturi portion 8 via a section hole 18 formed in the suction piston 3, and the atmospheric pressure chamber 16 is connected to the intake passage 2 located upstream of the suction piston 3 via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22. Fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21. Fuel is fed into the intake passage 2 from the nozzle 23 after it is metered by an annular gap formed between the needle 4 and the metering jet 21.

An annular air passage 24 is formed around the metering jet 21. A plurality of air bleed bores 25 interconnecting the annular air passage 24 to the interior of the metering jet 21 is formed in the inner peripheral wall of the metering jet 21. The annular air passage 24 is connected to an air bleed passage 26 formed in the carburetor body 1. In addition, an auxiliary air bleed bore 27 is formed on the upper wall of the fuel passage 20 located downstream of the metering jet 21. The auxiliary air bleed bore 27 is connected to the air bleed passage 26. The needle 4 has a reduced diameter portion 28 at the central portion thereof. The reduced diameter portion 28 is positioned within the metering jet 21 when the suction piston 3 closes the intake passage 2 to its maximum extent.

A raised wall 29, projecting horizontally into the intake passage 2, is formed at the upper end of the spacer 5. Flow control is effected between the raised wall 29 and the tip end portion of the suction piston 3. When the engine is started, air flows downward within the intake passage 2. At this time, since the air flow is restricted between the suction piston 3 and the raised wall 29, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

The air bleed passage 26 is connected to a throttle control valve 30 and a vacuum control valve 31. The throttle control valve 30 comprises a circular bore 33 extending in the longitudinal direction of a housing 32, and a wax valve 34. A push rod 35, driven by the wax valve 34, is slidably inserted into the circular bore 33. The push rod 35 has a pair of spaced enlarged portions 36 and 37. The enlarged portion 37 has a frustum-shaped inner end 38. The outer end of the enlarged portion 37 projects outwardly from the housing 32. A disc-shaped head 39 is formed in one piece on the tip of the enlarged portion 37. In addition, the projecting outer end of the enlarged portion 37 is surrounded by a seal member 40 mounted on the housing 32. On the other hand, the housing 32 has an increased diameter bore 41 formed therein. A wax valve holder 42 is fitted into the increased diameter bore 41. In addition, an O ring 43 is inserted between the wax valve holder 42 and the inner wall of the increased diameter bore 41. A plug 44 is screwed into the increased diameter portion 41 and fixed onto the housing 32 via a gasket 45 and, thus, the wax valve 34 is fixed into the housing 32 by means of the plug 44 via the wax valve holder 42. A cooling water chamber 46 is formed between the wax valve holder 42 and the plug 44, and a cooling water feed pipe 47 is connected to the cooling water chamber 46. Cooling water of the engine, fed into the cooling water chamber 46 via the cooling water feed pipe 47, is discharged from a cooling water discharge hole 48 after the cooling water heats the wax valve 34.

Figure 2:
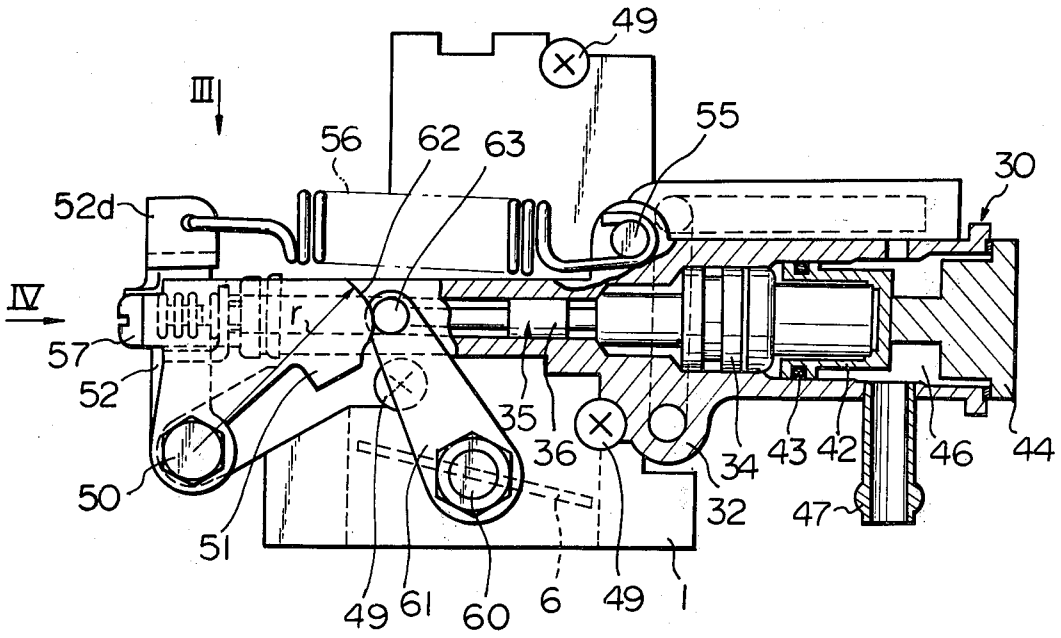
FIG. 2 is a side view, partly in cross-section, of a throttle control valve.
Figure 3:
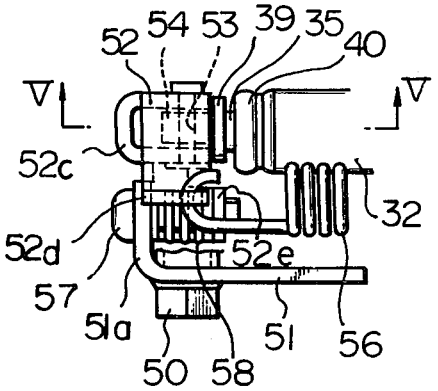
FIG. 3 is a plan view taken along the arrow III in FIG. 2.
Figure 4:
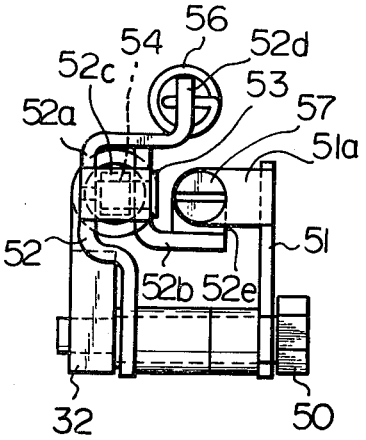
FIG. 4 is a side view taken along the arrow IV in FIG. 2.
Figure 5:
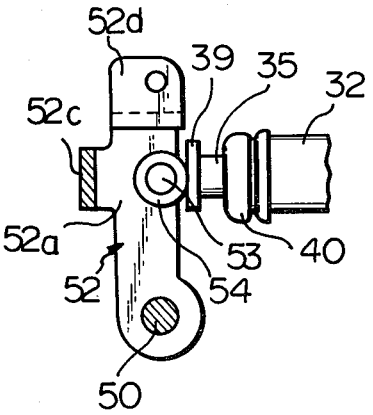
FIG. 5 is a cross-sectional view taken along the line V—V in FIG. 3.

As illustrated in FIG. 2, the housing 32 of the throttle control valve 30 is fixed onto the carburetor body 1 by means of three bolts 49. Referring to FIGS. 2 through 5, a bolt 50, functioning as a pivot, is secured onto the housing 32. A cam 51 and a lever 52 are rotatably mounted on the bolt 50. The lever 52 comprises an L-shaped member **52*b* spaced from an intermediate portion 52*a* of the lever 52. The intermediate portion 52*a* and the L-shaped member 52*b* are interconnected with each other by means of a U-shaped member 52*c*. A pin 53, extending through the intermediate portion 52*a* and the L-shaped member 52*b*, is fixed onto them, and a roller 54 is rotatably mounted on the pin 53. A tension spring 56 is arranged between a tip 52*d* of the lever 52 and a pin 55 fixed onto the housing 32 so that the roller 54 is continuously pressed in contact with the disc-shaped head 39 of the push rod 35 due to the spring force of the tension spring 56**.

An arm **52*e* is formed in one piece on the tip of the L-shaped member 52*b* of the lever 52. In addition, an arm 51*a*, facing the arm 52*e*, is formed in one piece on the end portion of the cam 51. An adjusting screw 57 is inserted into a bore (not shown) formed in the arm 51*a* of the cam 51, and the tip of the adjusting screw 57 is screwed into the arm 52*e* of the lever 52. Consequently, it is possible to adjust the relative position between the lever 52 and the cam 51 by rotating the adjusting screw 57. A compression spring 58, which serves to prevent the adjusting screw 57 from being loosened, is inserted between the arms 51*a* and 52*e*. The rotating force of the lever 52 is transferred to the cam 51 via the adjusting screw 57. When the lever 52 is rotated in the clockwise direction in FIG. 2, the cam 51 is accordingly rotated in the clockwise direction. On the other hand, a lever 61 is fixed onto a valve shaft 60 of the throttle valve 6, and a pin 63, which is engageable with a cam face 62 of the cam 51, is fixed onto the tip of the lever 61. As will be understood from FIG. 2, the radius r of the cam face 62, which is measured from the bolt 50**, is gradually reduced toward the clockwise direction.

FIG. 2 illustrates the case where the engine temperature is low. At this time, the throttle valve 6 remains open by means of the cam 51. When the engine is started and the temperature of the cooling water of the engine is increased, the push rod 35 moves toward the left in FIG. 2 under the operation of the wax valve 34. As a result, since the lever 52 is rotated in the counterclockwise direction in FIG. 2, the cam 51 is also rotated in the counterclockwise direction and, thus, the throttle valve 6 is gradually closed. As mentioned above, since the roller 54 is provided between the lever 52 and the disc-shaped head 39 of the push rod 35, the lever 52 is smoothly rotated when the push rod 35 moves toward the left in FIG. 2.

Returning once more to FIG. 1, an atmospheric pressure chamber 70 is formed between the enlarged portions 35 and 36 within the circular bore 33 of the throttle control valve 30. The atmospheric pressure chamber 70 is always open to the atmosphere via an air hole 71. In addition, a first port 72, which is continuously open to the atmospheric pressure chamber 70, a second port 73, and a third port 74 are formed in the housing 32. A jet 75 is inserted into the third port 74. The fluid connection between the second port 73 and the atmospheric pressure chamber 70 is controlled by the enlarged portion 36. The fluid connection between the third port 74 and the atmospheric pressure chamber 70 is controlled by the enlarged portion 35.

A pair of pistons 80, 81 is slidably inserted into the interior of the vacuum control valve 31. A partition 83 having a restricted opening 82 is arranged between the pistons 80 and 81. A first vacuum chamber 84 is formed between the piston 80 and the partition 83. In addition, a compression spring 85 is inserted between the piston 80 and the partition 83. The first vacuum chamber 84 is connected via a vacuum conduit 87 to a vacuum port 86 which is open to the intake passage 2 located downstream of the throttle valve 6. The piston 80 comprises a pair of spaced piston members **80*a*, 80*b*. A pair of ports 89, 90 is open to an interior chamber 88 formed between the piston members 80*a* and 80*b*. The port 89 is connected via a conduit 92 to a port 91 which is open to the vacuum chamber 15. The port 90 is connected to the second port 73 of the throttle control valve 30. A second vacuum chamber 93 is formed between the piston 81 and the partition 83, and a compression spring 94 is inserted between the piston 81 and the partition 83. In addition, a seal member 95 is fixed onto the top face of the piston 81. A port 97, which is continuously open to an interior chamber 96 formed between the top face of the piston 81 and the inner wall of the housing of the vacuum control valve 31, is formed in the housing of the vacuum control valve 31 and connected to the first port 72 of the throttle control valve 30. A port 98, which is covered or uncovered by the seal member 95 of the piston 81, is formed in the housing of the vacuum control valve 31, and a jet 99 is inserted into the port 98. This port 98 and the third port 74 of the throttle control valve 30 are connected to the aid bleed passage 26**.

FIG. 1 illustrates the case wherein the engine temperature is low and wherein the engine is stopped. At this time, the suction piston 3 is located at a position wherein it closes the intake passage 2 to the maximum extent. When the starter motor (not shown) is rotated for starting the engine, since the level of vacuum which is produced in the intake passage 2 located downstream of the throttle valve 6 is small, the pistons 80, 81 of the vacuum control valve 31 are located at a position illustrated in FIG. 1. Since the vacuum chamber 15 is open to the atmosphere via the vacuum control valve 31 and the throttle control valve 30, the pressure in the vacuum chamber 15 is equal to the atmospheric pressure. Therefore, the suction piston 3 remains stopped at a position illustrated in FIG. 1. Since the reduced diameter portion 28 of the needle 4 is located within the metering jet 21, the cross-sectional area of the annular gap formed between the needle 4 and the metering jet 21 is large and, thus, a large amount of fuel is fed into the intake passage 2 from the nozzle 23. At this time, since the port 98 of the vacuum control valve 31 is closed by the seal member 95 of the piston 81 and the third port 74 of the throttle control valve 30 is slightly opened, an extremely small amount of air is fed into the fuel passage 20 from the air bleed bores 25, 27. Consequently, when the engine is rotated by the starter motor, an extremely rich air-fuel mixture is fed into the cylinder of the engine.

If the engine begins to rotate by its own power, since the level of vacuum which is produced in the intake passage 2 located downstream of the throttle valve 6 becomes large, the piston 80 of the vacuum control valve 31 instantaneously moves toward the right in FIG. 1 against the compression spring 85. As a result, the ports 89, 90 are closed by the piston member **80*a* of the piston 80. Therefore, since vacuum in the venturi portion 8 acts on the vacuum chamber 15 via the suction hole 18, the suction piston 3 moves toward the left in FIG. 1. As a result of this, since the reduced diameter portion 28 of the needle 4 comes out from the metering jet 21, the cross-sectional area of the annular gap formed between the needle 4 and the metering jet 21 is reduced. Thus, the amount of fuel fed from the nozzle 23** is reduced.

Even though the level of vacuum in the intake passage 2 located downstream of the throttle valve 6 is large, since the restricted opening 82 is present between the first vacuum chamber 84 and the second vacuum chamber 93, the level of vacuum in the second vacuum chamber 84 does not instantaneously become large. Consequently, the port 98 remains closed by the seal member 95 of the piston 81 for a brief period of time. Since the level of vacuum in the second vacuum chamber 93 becomes large a little while after the engine begins to rotate by its own power, the piston 81 gradually moves toward the left in FIG. 1 against the compression spring 94. Thus, the port 98 gradually opens. As a result of this, since the amount of air fed into the fuel passage 20 from the air bleed bores 25, 27 is increased, the air-fuel mixture fed into the cylinders of the engine gradually becomes lean.

As described above, when the engine begins to rotate by its own power, the amount of fuel fed from the nozzle 23 into the intake passage 2 is first abruptly and then gradually reduced, therefore the air-fuel mixture fed into the cylinder of the engine does not become excessively lean immediately after the engine begins to rotate by its own power and the air-fuel mixture fed into the cylinder of the engine does not become excessively rich shortly after the engine begins to rotate by its own power. This makes it possible to obtain stable engine idling operation.

After this, since the push rod 35 moves toward the left in FIG. 1 as the temperature of cooling water of the engine is increased, the opening area of the third port 74 is gradually increased. As a result of this, since the amount of air fed into the fuel passage 20 from the air bleed bores 25, 27 is gradually increased, the air-fuel mixture fed into the cylinder of the engine gradually becomes lean. Subsequently, when the engine warm-up is completed, since the third port 74 fully opens, the air-fuel mixture having a predetermined air-fuel ratio is fed into the cylinders of the engine.

When the engine warm-up is completed, the second port 73 is closed by the enlarged portion 36 of the push rod 35. Should the engine be started when the engine temperature is high, since the vacuum in the venturi portion 8 acts on the vacuum chamber 15, the reduced diameter portion 28 of the needle 4 instantaneously comes out from the metering jet 21. Consequently, the amount of fuel fed from the nozzle 23 into the intake passage 2 becomes small as compared with the case wherein the engine is started when the engine temperature is low. As described earlier, since the port 98 of the vacuum control valve 31 remains closed by the seal member 95 of the piston 81 immediately after the engine begins to rotate by its own power, a large amount of fuel is fed into the intake passage 2. Then, since the port 98 of the vacuum control valve 31 is gradually opened, the amount of fuel fed into the intake passage 2 is gradually reduced. Therefore, it is possible to prevent the engine from being stopped immediately after the engine begins to rotate by its own power, and it is possible to prevent the occurrence of misfires following a brief interval of time after the engine begins to rotate by its own power.

Figure 6:
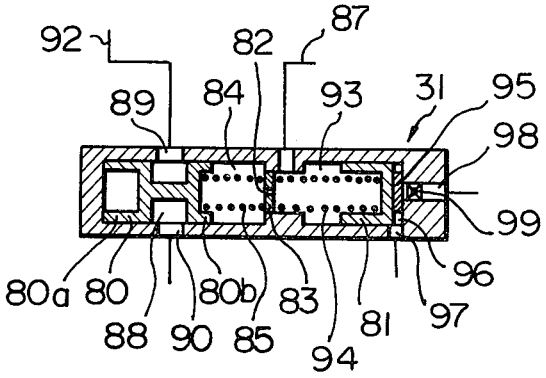
FIG. 6 is a cross-sectional side view of another embodiment of the vacuum control valve illustrated in FIG. 1.

FIG. 6 illustrates another embodiment of the vacuum control valve 31. In this embodiment, the second vacuum chamber 93 is connected to the vacuum port 86 (FIG. 1) via the vacuum conduit 87, and the first vacuum chamber 84 is connected to the second vacuum chamber 93 via the restricted opening 82. Consequently, in this embodiment, when the engine begins to rotate by its own power, since the seal member 95 of the piston 81 instantaneously opens the port 98, the amount of fuel fed from the nozzle 23 into the intake passage 2 is reduced. On the other hand, since the vacuum chamber 15 is open to the atmosphere via the vacuum control valve 31 immediately after the engine begins to rotate by its own power, the suction piston 3 remains at a position illustrated in FIG. 1. Then, since the piston 80 moves toward the right in FIG. 6 and closes the ports 89, 90 a little while after the engine begins to rotate by its own power, vacuum acts on the vacuum chamber 15 of the suction piston 3. As a result of this, the suction piston 3 moves toward the left in FIG. 1 and, thus, the amount of fuel fed from the nozzle 23 into the intake passage 2 is reduced. Consequently, also in this embodiment, it is possible to prevent the engine from being stopped immediately after the engine begins to rotate by its own power, and it is possible to prevent misfires a little while after the engine begins to rotate by its own power.

Figure 7:
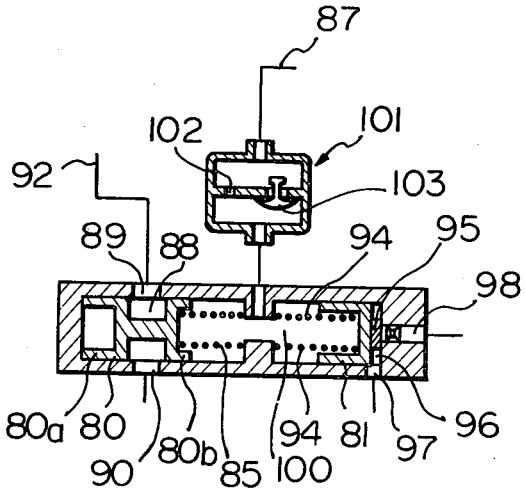
FIG. 7 is a cross-sectional side view of a further embodiment of the vacuum control valve illustrated in FIG. 1.

FIG. 7 illustrates a further embodiment of the vacuum control valve 31. In this embodiment, a common vacuum chamber 100 is formed between the pistons 80 and 81 and connected to the vacuum port 86 (FIG. 1) via a delay valve 101 and the vacuum conduit 87. The delay valve 101 has a restricted opening 102 and a check valve 103 which are arranged in parallel. In this embodiment, the port 98 remains closed by the seal member 95 of the piston 81, and the vacuum chamber 15 (FIG. 1) remains open to the atmosphere for a brief time interval after the engine begins to rotate by its own power. Consequently, a large amount of fuel is fed into the intake passage 2 from the nozzle 23 immediately after the engine is started. Then, since vacuum acts on the vacuum chamber 15 a little while after the engine is started, the suction piston 3 moves toward the vacuum chamber 15. In addition, the amount of air fed into the fuel passage 20 from the air bleed bores 25, 27 is increased a little while after the engine is started. Consequently, the fuel fed into the intake passage 2 from the nozzle 23 is gradually reduced. It is preferable that this embodiment be applied to an engine in which fuel fed from the carburetor is not instantaneously fed into the cylinders of the engine, for example, an engine in which the intake manifold has a large volume, or an engine in which the intermediate portion of the intake manifold extends downwardly from the cylinder head of the engine.

According to the present invention, the air-fuel ratio of the fuel mixture fed into the cylinders of the engine is abruptly increased immediately after the engine begins to rotate by its own power, and then the air-fuel ratio of the fuel mixture is gradually increased. Consequently, the air-fuel mixture fed into the cylinder of the engine does not become excessively lean immediately after the engine begins to rotate by its own power, and the air-fuel mixture fed into the cylinder of the engine does not become excessively rich shortly after the engine begins to rotate by its own power. Therefore, it is possible to prevent the engine from being stopped immediately after the engine begins to rotate by its own power, and it is possible to prevent misfires shortly after the engine begins to rotate by its own power.

While the invention has been described with reference to specific embodiments chosen for purposes of illustration, it should be apparent that numerous modifications could be made thereto by those skilled in the art without departing from the basic concept and scope of the invention.

We claim:

1. A variable venturi-type carburetor comprising:
- an intake passage formed in said carburetor and having an inner wall;
- a casing having therein an interior chamber which extends perpendicular to said intake passage;
- a suction piston movably inserted into said casing and having a tip face which projects into said intake passage and defines a venturi portion, said suction piston dividing the interior chamber of said casing into an atmospheric pressure chamber and a vacuum chamber which is connected to said venturi portion for moving said suction piston in response to a change in the amount of air flowing within said intake passage;
- a throttle valve arranged in said intake passage located downstream of said suction piston;
- a fuel passage having a metering jet therein and being open to said intake passage for feeding fuel into said intake passage;
- a needle fixed onto the tip face of said suction piston and extending through said fuel passage and said metering jet;
- an air bleed passage having an air inlet and an air outlet which is open to said fuel passage, said air inlet being open to the atmosphere;
- an air feed passage having an air inlet and an air outlet which is open to said vacuum chamber, said air inlet being open to the atmosphere; and
- control means arranged in said air bleed passage and said air feed passage and controlling the flow areas of said air bleed passage and said air feed passage in response to a change in vacuum produced in said intake passage located downstream of said throttle valve for opening said air feed passage and shutting off said air bleed passage when the level of said vacuum is smaller than a predetermined level and for shutting off said air feed passage and opening said air bleed passage when the level of said vacuum is greater than the predetermined level, said control means having a delay device for delaying the shutting-off operation of said air feed passage and/or the opening operation of said air bleed passage for a period of time after the level of said vacuum becomes greater than the predetermined level.

2. A variable venturi-type carburetor according to claim 1, wherein said control means comprises a first vacuum chamber connected to said intake passage located downstream of said throttle valve, a first valve actuated in response to a change in vacuum in said first vacuum chamber and controlling the flow area of said air feed passage, a second vacuum chamber connected to said intake passage located downstream of said throttle valve, and a second valve actuated in response to a change in vacuum in said second vacuum chamber and controlling the flow area of said air bleed passage.

3. A variable venturi-type carburetor according to claim 2, wherein said control means comprises a single housing having therein all of said first vacuum chamber, said first valve, said second vacuum chamber, and said second valve.

4. A variable venturi-type carburetor according to claim 2, wherein each of said first valve and said second valve comprises a spring-located piston.

5. A variable venturi-type carburetor according to claim 2, wherein said delay device comprises a restricted opening arranged between said first vacuum chamber and said intake passage located downstream of said throttle valve for delaying the shutting-off operation of said air feed passage.

6. A variable venturi-type carburetor according to claim 5, wherein said restricted opening is formed in a partition separating said first vacuum chamber from said second vacuum chamber, said second vaccum chamber being connected to said intake passage located downstream of said throttle valve.

7. A variable venturi-type carburetor according to claim 2, wherein said delay device comprises a restricted opening arranged between said second vacuum chamber and said intake passage located downstream of said throttle valve for delaying the opening operation of said air bleed passage.

8. A variable venturi-type carburetor according to claim 7, wherein said restricted opening is formed in a partition separating said first vacuum chamber from said second vacuum chamber, said first vacuum chamber being connected to said intake passage located downstream of said throttle valve.

9. A variable venturi-type carburetor according to claim 2, wherein said delay device comprises a restricted opening arranged in a vacuum passage interconnecting both said first vacuum chamber and said second vacuum chamber to said intake passage located downstream of said throttle valve.

10. A variable venturi-type carburetor according to claim 9, wherein a check valve is arranged in said vacuum passage in parallel to said restricted opening.

11. A variable venturi-type carburetor according to claim 1, wherein said needle has a reduced diameter portion which is located within said metering jet when said suction piston closes said intake passage to the maximum extent.

12. A variable venturi-type carburetor according to claim 1, wherein said carburetor comprises a control valve arranged in said air feed passage and actuated in response to a change in the temperature of an engine for shutting off said air feed passage when the temperature of the engine becomes higher than a predetermined temperature.

13. A variable venturi-type carburetor according to claim 1, wherein the air outlet of said air bleed passage is formed on an inner circumferential wall of said metering jet.

14. A variable venturi-type carburetor according to claim 13, wherein an auxiliary air bleed passage is branched off from said air bleed passage and connected to said fuel passage located downstream of said metering jet.

15. A variable venturi-type carburetor according to claim 1, wherein a raised wall is formed on the inner wall of said intake passage, which faces the tip face of said suction piston, at a position located upstream of and adjacent to said suction piston, the tip face of said suction piston having an upstream end portion which cooperates with said raised wall for controlling the amount of air flowing within said venturi portion.

* * * * *